US008193464B2

(12) United States Patent
Ahn et al.

(10) Patent No.: US 8,193,464 B2
(45) Date of Patent: Jun. 5, 2012

(54) MICRO SWITCH

(75) Inventors: Kil Young Ahn, Daejeon (KR); Sang Chul Lee, Chungcheongbuk-Do (KR); Sub Bae, Seoul (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 201 days.

(21) Appl. No.: 12/581,306

(22) Filed: Oct. 19, 2009

(65) Prior Publication Data

US 2010/0101922 A1 Apr. 29, 2010

(30) Foreign Application Priority Data

Oct. 23, 2008 (KR) ..... 10-2008-0104444

(51) Int. Cl.
*H01H 5/18* (2006.01)

(52) U.S. Cl. ..... 200/454; 200/456

(58) Field of Classification Search ..... 200/447–467, 200/573, 574, 303, 307; 335/205–207
See application file for complete search history.

(56) References Cited

U.S. PATENT DOCUMENTS

| | | | | |
|---|---|---|---|---|
| 2,374,986 | A | 5/1945 | Fetter | |
| 2,849,580 | A * | 8/1958 | Tateishi | 218/25 |
| 3,400,234 | A * | 9/1968 | Long | 200/467 |
| 3,529,105 | A * | 9/1970 | Huffman | 200/454 |
| 3,809,837 | A * | 5/1974 | Yoshioka | 200/332 |
| 3,838,237 | A * | 9/1974 | Hoshioka | 200/452 |
| 4,168,412 | A * | 9/1979 | Smith | 200/456 |
| 5,913,415 | A * | 6/1999 | Kishi et al. | 200/456 |
| 6,242,706 | B1 * | 6/2001 | Miyata | 200/537 |
| 2009/0014300 | A1 | 1/2009 | Ahn | |

FOREIGN PATENT DOCUMENTS

| | | |
|---|---|---|
| CN | 2862299 | 1/2007 |
| CN | 201029080 | 2/2008 |
| KR | 20-1993-6386 | 9/1993 |

OTHER PUBLICATIONS

Office Action from Korea, mail date is Jul. 2010.
China Office action, dated Jan. 12, 2012 along with an english translation thereof.

* cited by examiner

*Primary Examiner* — Michael Friedhofer
(74) *Attorney, Agent, or Firm* — Greenblum & Bernstein P.L.C.

(57) ABSTRACT

Disclosed is a micro switch having a high capability of cutting off a direct current. In the micro switch including a stationary contact, a movable contact having a closed position where it contacts the stationary contact or an open position where it is separated from the stationary contact, a movable contact rod for supporting the movable contact, a plunger for pressurizing the movable contact rod upon being pressed, and a leaf spring for supplying a driving force to the movable contact rod to convert a position of the contacts being contacted or separated, a permanent magnet is installed at a position adjacent to the movable contact and the stationary contact, so as to extend an arc generated between the movable contact and the stationary contact upon separating the movable contact from the stationary contact, whereby the arc can be fast extinguished.

7 Claims, 4 Drawing Sheets

MICRO SWITCH

CROSS-REFERENCE TO A RELATED APPLICATION

The present disclosure relates to subject matter contained in priority Korean Application No. 10-2008-0104444, filed on Oct. 23, 2008, which is herein expressly incorporated by reference in its entirety.

BACKGROUND OF THE INVENTION

1. Field of the Invention

The present invention relates to a micro switch, and particularly, to a micro switch having an excellent capability of opening contacts for a direct current and being capable of rapidly extinguishing an arc.

2. Background of the Invention

A micro switch denotes a compact switch which converts a physical force into a driving force for switching an electric switch on or off so as to switch internal contacts on or off. Such micro switch is widely being used as a source for generating an electric signal indicating an operation of a mechanical device at a specific position. Further, it allows contacts to be fast switched on or off, and accordingly it is also used to control a current supply to an electric load device utilized in a electric power equipments.

The micro switch utilized in the electric power equipments is typically capable of being switched on or off to conduct or cut off a direct current with maximum voltage of 250 volts (hereinafter, referred to as 'V') and maximum current of 16 ampere (hereinafter, referred to as 'A'), for example.

However, the related art micro switch just has a short separated distance (i.e., open distance) between its internally disposed movable contact and stationary contact (e.g., a normally open contact or normally closed contact) upon an opening operation, and also is not equipped with any member for fast extinguishing an arc generated between the movable contact and the stationary contact upon the opening operation. Accordingly, the related art micro switch may be switched on or off so as to conduct or cut off a direct current with 250V voltage and 0.3 A current, for example. That is, a direct current level which can be conducted or cut off is drastically decreased. For a cycle of alternating current having a period (time interval) with a plus (+) value, a time point with zero (0) current and a period (time interval) with a minus (−) value, the micro switch is switched off (opened) at the time point where a current becomes zero (0) (i.e., zero (0) point), so as to cut off (block) a relatively great alternating current. However, the direct current does not have the zero point, and thereby an amount of direct current which can be cut off by switching the micro switch off may drastically be decreased.

Contrast to this, a circuit breaker of electric power equipments uses a motor as a driving source for charging its internal trip spring. Here, in case of constructing a control circuit including such motor and a magnetic contactor for controlling driving/stopping of the motor, such construction requires a micro switch capable of cutting off a direct current with higher than 250V voltage and 1.0 A current, for example.

However, the related art micro switch has too short open distance (e.g., about 1 millimeter) between the movable contact and the stationary contact, thereby merely cutting off a less amount of direct current. As a result, the micro switch is not appropriate to be used for controlling an operation of a motor installed in electric power equipment.

Furthermore, since the related art micro switch is not equipped with a member for fast extinguishing an arc generated between the movable contact and the stationary contact when the movable contact is separated from the stationary contact, it cannot effectively cut off a great direct current. Accordingly, when a great direct current is generated, the motor disposed at a rear side of the micro switch may be damaged as well as the micro switch. In addition, it is impossible to charge a trip spring of a breaker, whereby the breaker may not be operable.

SUMMARY OF THE INVENTION

Therefore, in order to solve those problems of the related art, an object of the present invention is to provide a micro switch capable of being employed in electric power equipment due to its high capability of cutting off a great direct current.

Another object of the present invention is to provide a micro switch capable of being employed in electric power equipment due to its high capability of cutting off a great direct current by increasing an open distance between a movable contact and a stationary contact (a normally open contact or normally closed contact) disposed in the micro switch.

To achieve these and other advantages and in accordance with the purpose of the present invention, as embodied and broadly described herein, there is provided a micro switch, including a stationary contact, a movable contact having a closed position where it contacts the stationary contact and an open position where it is separated from the stationary contact, a movable contact rod for supporting the movable contact, a plunger for pressurizing the movable contact rod upon being pressed, and a leaf spring for supplying a driving force to the movable contact rod to convert a position of the contacts being contacted or separated, the micro switch comprising a permanent magnet installed at a position adjacent to the movable contact and the stationary contact.

In another aspect of the present invention, there is provided a micro switch, including a normally closed terminal rod with a contact, a movable contact having a closed position where it is in contact with the contact of the normally closed terminal rod and a position where it is separated from the contact of the normally closed terminal rod, a movable contact rod for supporting the movable contact, a plunger for pressurizing the movable contact rod upon being pressed, and a leaf spring for supplying a driving force to the movable contact rod to convert a position of the contacts being contacted or separated, the micro switch comprising a permanent magnet installed at a position adjacent to the movable contact and the contact of the normally closed terminal rod, and a stopper configured to restrict the movement of the movable contact when the movable contact is separated from the contact of the normally closed terminal rod, wherein the stopper is configured as a flat plate member without a protruded contact.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The objects of the present invention and configuration and operation effects of the present invention to achieve the objects will be understood more clearly through the detailed description herein of the preferred embodiments of the present invention with reference to the accompanying drawings.

Figure 1:
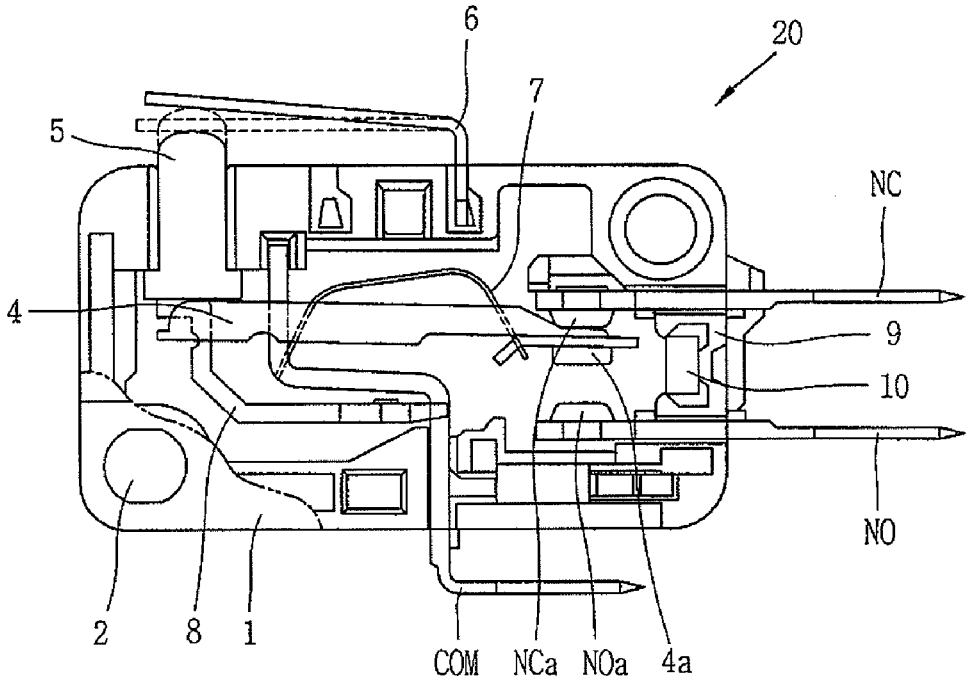
FIG. 1 is a longitudinal cross-sectional view showing an internal construction of a double terminal type micro switch in accordance with the present invention.
Figure 4:
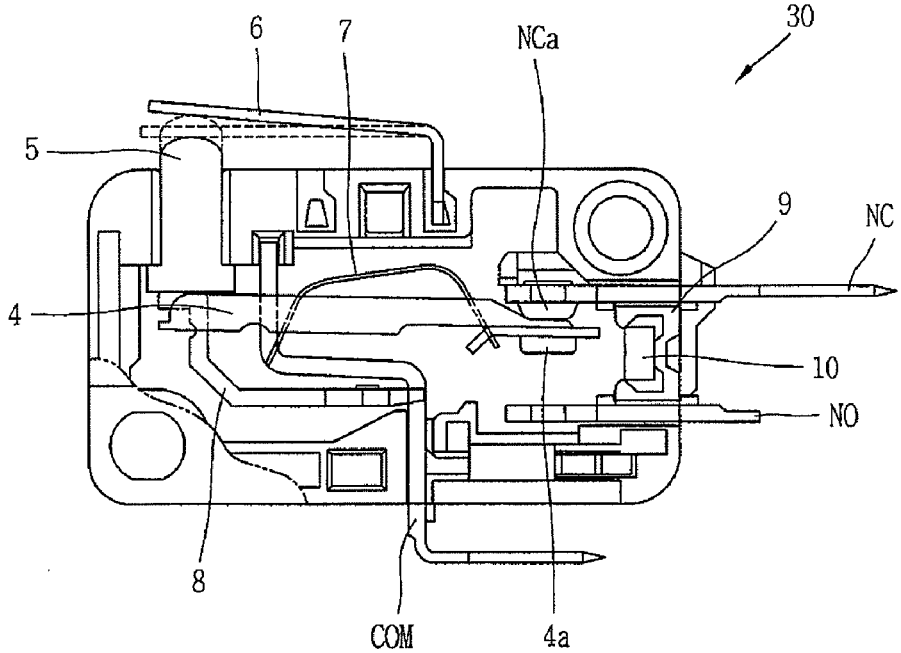
FIG. 4 is a longitudinal cross-sectional view showing an internal construction of a normally closed type micro switch in accordance with the present invention.
Figure 5:
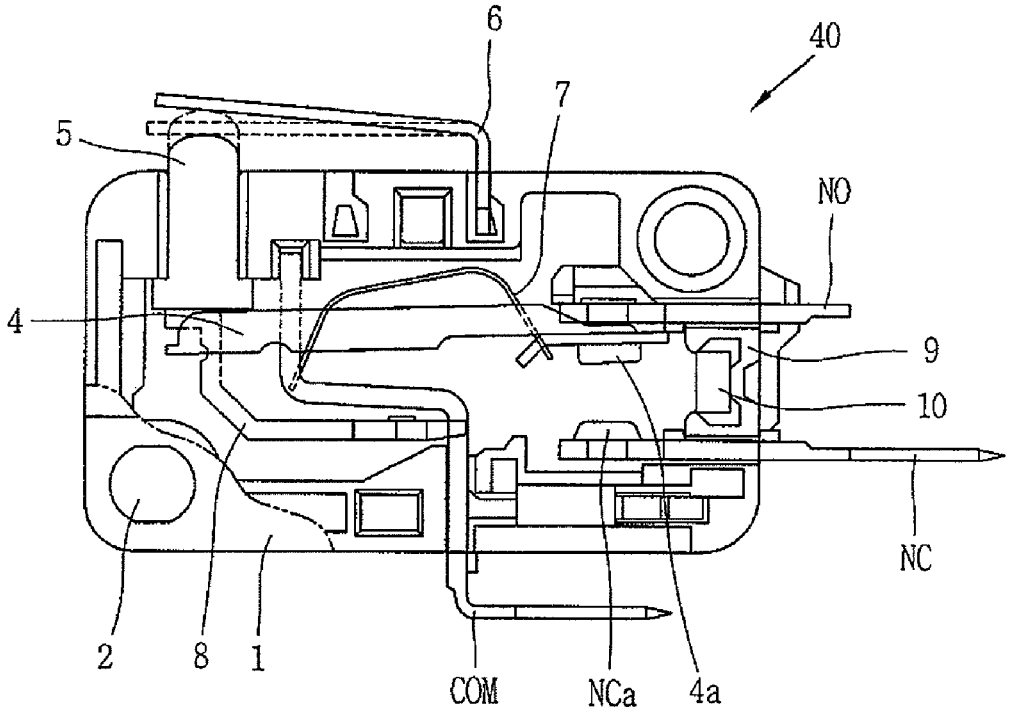
FIG. 5 is a longitudinal cross-sectional view showing an internal construction of a normally open type micro switch in accordance with the present invention.

As shown in the drawings, micro switches according to the present invention may include a double terminal type micro switch 20 as shown in FIG. 1, and a normally closed type micro switch 30 as shown in FIG. 4 or a normally open type micro switch 40 as shown in FIG. 5.

Referring to FIGS. 1 to 5, each of micro switches 20, 30 and 40 according to the present invention may commonly include a stationary contact (i.e., a normally closed terminal contact NCa or normally open terminal contact NOa), a movable contact 4*a* having a position where it is in contact with the stationary contact NCa or NOa and a position where it is separated from the stationary contact NCa or NOa, a movable contact rod 4 for supporting the movable contact 4*a*, a plunger 5 (so-called push button) for pressurizing the movable contact 4 upon being pressed, and a leaf spring 7 for supplying a driving force to the movable contact rod 4 to convert a position of the contacts being contacted or separated.

Each of the micro switches 20, 30 and 40 according to the present invention may further commonly include an outer case 1, which serves as an enclosure for accommodating components, has an accommodation groove to maintain such components at their aligned positions without fluctuation, and provides an electric insulation against the exterior. The outer case 1 is configured such that two enclosure pieces are assembled to each other as one set, for the sake of assembling and disassembling components. Coupling screw holes 2 for coupling or separating the two enclosure pieces are formed in both diagonal positions of the outer case 1. The normally closed terminal contact NCa and the normally open terminal contact NOa are contacts which are attached, for example, in a welding manner, respectively to end portions of a normally closed terminal NC and a normally open terminal NO both located in the outer case 1. A portion of at least one of the normally closed terminal NC and the normally open terminal NO, exposed out of the outer case 1, may be connected to a signal line (not shown) for transferring a contact switching signal to the exterior.

An actuator 6, which is commonly provided in each of the micro switches 20, 30 and 40 according to the present invention, may be protruded from the outer case 1 and configured to receive an external physical (driving) force for switching contacts on or off.

The actuator 6 may include a free end portion extending so as to outwardly protrude, and another end portion fixed into the outer case 1. The plunger 5 may be disposed below the free end portion of the actuator 6 such that the free end portion of the actuator 6 presses the plunger 5 in cooperation with an external force being applied thereto.

The leaf spring 7 has one end portion fixed to a common terminal COM, which will be explained later, so as to be supported thereby. The leaf spring 7 may also include a portion extending through the movable contact rod 4 from the one end portion and another end portion fixed to the movable contact rod 4.

An anchor 8 may include a portion connected to a part of the movable contact rod 4 to support the movable contact rod 4, and a fixed end portion. The anchor 8 may be disposed such that the portion supporting the movable contact rod 4 faces the plunger 5. Accordingly, when the plunger 5 is pressed, the movable contact rod 4 is pressed and moved together with the anchor 8.

In more detail, when the plunger 5 is pressed down, for example, in FIG. 5, the anchor 8 is rotated in a counterclockwise direction centering around the fixed end portion. As such, upon the plunger 5 being pressed, the movable contact rod 4, for example, a left end portion thereof in FIG. 5 is moved down, so as to press a left end portion of the leaf spring 7. Accordingly, a right end portion of the leaf spring 7, namely, an end portion having the movable contact 4*a* attached thereto is instantaneously moved down by a restoring force of the leaf spring 7 for maintaining its original state.

Each of the micro switches 20, 30 and 40 according to the present invention may include a common terminal COM. The common terminal COM may electrically be connectable to a power source side (not shown) via a wire.

Each of the micro switches 20, 30 and 40 may include, as characteristic components, a permanent magnet 10 installed at a position adjacent to the movable contact 4*a* and the stationary contact (i.e., the normally closed terminal contact NCa or the normally open terminal contact NOa). In the configuration of the micro switches 20, 30 and 40 according to the present invention, when the movable contact 4*a* is separated from the stationary contact (i.e., the normally closed terminal contact NCa), the permanent magnet 10 functions such that an arc generated between the movable contact 4*a* and the normally closed terminal contact NCa is attracted and dispersed by the permanent magnet 10, thereby rapidly extinguishing the arc. In more detail, assuming that a left side of the permanent magnet 10 is N-pole and a right side thereof is S-pole in a horizontal direction, a plurality of magnetic fluxes coming out from the N-pole towards the S-pole are generated around the permanent magnet 10. Such magnetic fluxes act such that the arc generated between the movable contact 4*a* and the normally closed terminal contact NCa is dispersed broadly and an arc resistance is increased, to thereby rapidly extinguish the arc. Hence, the micro switch 20, 30 or 40 can have a high capability of cutting off a direct current. It has been checked from the test results that the micro switch (see 20, 30 or 40 of the different embodiments) according to the present invention can cut off a direct current with a voltage higher than 250V and a current higher than 1.0

A. Therefore, it has been confirmed from the test results that the micro switch 20, 30 or 40 according to the present invention has a direct current cut-off capability enhanced by more than three times than the conventional micro switch with a capability of cutting off 0.3 A direct current.

In the meantime, as shown in FIGS. 4 and 5, each of the micro switches (i.e., 30 of FIG. 4 and 40 of FIG. 5) according to the present invention may include a normally closed terminal rod NC with the normally closed terminal contact NCa, a movable contact 4*a* having a closed position at which it contacts the stationary contact (i.e., the normally closed terminal contact NCa) and an open position at which it is separated from the stationary contact (i.e., the normally closed terminal contact NCa), and a movable contact rod 4 for supporting the movable contact 4*a*. The micro switch (i.e., 30 of FIG. 4 and 40 of FIG. 5) according to the present invention may further include a plunger 5 for pressurizing the movable contact rod 4 upon being pressed, and a leaf spring 7 for supplying a driving force, upon being pressed, to the movable contact rod 4 to convert a position of the contacts being contacted or separated. The micro switch (i.e., 30 of FIG. 4 and 40 of FIG. 5) according to the present invention may further include a permanent magnet 10 installed at a position adjacent to the movable contact 4*a* and the stationary contact (i.e., the normally closed terminal contact NCa), and a stopper for restricting the movement of the movable contact 4*a* when the movable contact 4*a* is separated from the stationary contact (i.e., the normally closed terminal contact NCa).

The stopper may be configured as a terminal rod (see the reference numeral NO in FIGS. 4 and 5) with a different length from that of the normally closed terminal rod NC. In the preferred embodiment, in more detail, the stopper may be configured as a normally open terminal rod NO. Preferably, the stopper may be configured as a flat plate member without a protruded contact. The stopper may be configured to be shorter in length than the normally closed terminal rod NC. Since the stopper is configured as a normally open terminal rod NO, the stopper is not used as a terminal for transferring a signal to the exterior and thus does not have to be connected with an external signal line. Accordingly, the stopper is configured to be shorter in length than the normally closed terminal rod NC, to which an external signal line is to be connected, resulting in facilitating the two rods to be distinguished from each other, thereby preventing an erroneous wiring of a signal line.

The micro switch (i.e., 30 of FIG. 4 and 40 of FIG. 5) may further include a support member 9 for supporting the permanent magnet 10 to prevent its separation. Preferably, in order to prevent the separation of the permanent magnet 10, the support member 9 may have a shape similar to Alphabet 'E' or number '3' with a raised portion for preventing the separation. The permanent magnet 10 is press-fitted in the support member 9 such that the permanent magnet 10 can be supported to be prevented from the separation by means of the raised portion. The support member 9 is raised in a longitudinal direction between the normally closed terminal rod NC and the normally open terminal rod NO, to be then press-fitted for installation.

The micro switch shown in FIG. 4 is a normally closed type micro switch 30. The movable contact 4*a* of the movable contact rod 4 is commonly located at a position where it is in contact with the normally closed terminal rod NC, which is distinguished from the normally open terminal rod NO by being configured to be longer than that. Accordingly, a power source side via the common terminal COM is electrically connected to a load device or driving source (e.g., a lamp, a motor and the like) connected to the normally closed terminal rod NC via a signal line (not shown), so as to configure a closed circuit. That is, a current introduced from is the power source side via the common terminal COM flows towards the lamp or motor via the signal line, passing through the movable contact rod 4 and the normally closed terminal rod NC of the normally closed type micro switch 30.

The micro switch as shown in FIG. 5 is a normally open type micro switch 40. The movable contact 4*a* of the movable contact rod 4 is commonly located at a position where it is in contact with the normally open terminal rod NO, which is distinguished from the normally closed terminal rod NC by being configured to be shorter than that. Accordingly, the power source side via the common terminal COM is normally electrically disconnected to the load device or driving source (e.g., a lamp, a motor and the like) connected to the normally closed terminal rod NC via a signal line (not shown), so as to allow a circuit to be open. That is, a current introduced from the power source side via the common terminal COM merely flows up to the normally open terminal rod NO. Afterwards, since any signal line is not connected, a current does not flow towards the external load device or driving source, e.g., the lamp or motor.

Figure 2:
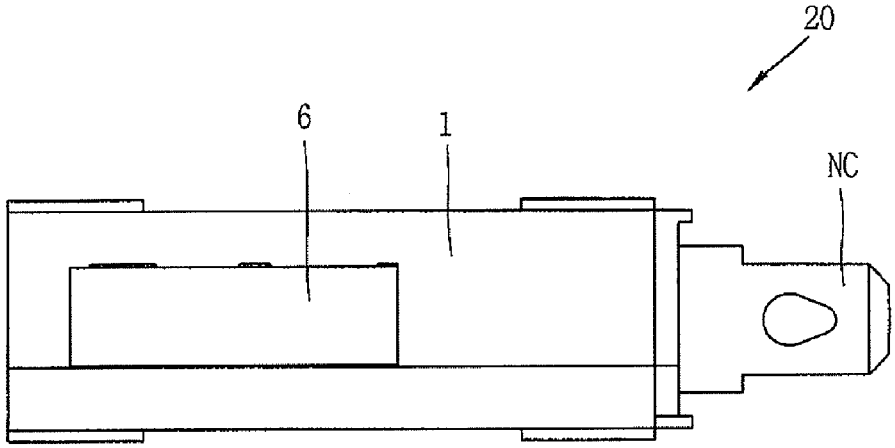
FIG. 2 is a plane view showing an upper appearance of the micro switch shown in FIG. 1.
Figure 3:
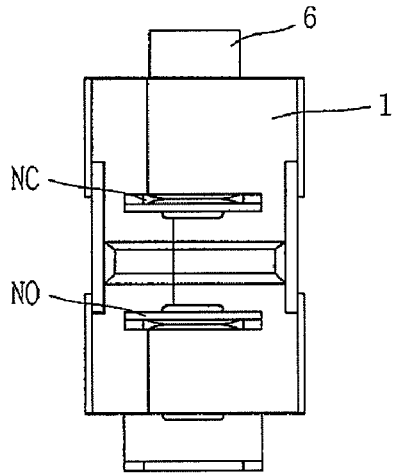
FIG. 3 is a front view showing a front appearance of the micro switch shown in FIG. 1.

In the meantime, the micro switch shown in FIGS. 1 to 3 is a double terminal type micro switch 20. The double terminal type micro switch 20 includes a normally closed terminal rod NC with a normally closed terminal contact NCa as a stationary contact, a normally open terminal rod NO with a normally open terminal contact NOa as a stationary contact, a movable contact 4*a* having a closed position where it contacts the stationary contact (i.e., the normally closed terminal contact NCa) of the normally closed terminal rod NC or an open position where it contacts the stationary contact (i.e., the normally open terminal contact NOa), a movable contact rod 4 for supporting the movable contact 4*a*, a plunger 5 for pressurizing the movable contact rod 4 upon being pressed, and a leaf spring 7 for supplying a driving force to the movable contact rod 4 to convert a position of the contacts being contacted or separated. The double terminal type micro switch 20 further includes a permanent magnet 10 installed at a position adjacent to the movable contact 4*a* and the stationary contact (i.e., the normally closed terminal contact NCa).

The micro switch 20 shown in FIG. 1 includes a support member 9 for supporting the permanent magnet 10 to prevent its separation. Preferably, in order to prevent the separation of the permanent magnet 10, the support member 9 may have a shape similar to Alphabet 'E' or number '3' with a raised portion for preventing the separation. The permanent magnet 10 is press-fitted in the support member 9 such that the permanent magnet 10 can be supported to be prevented from the separation by means of the raised portion. The support member 9 is raised in a longitudinal direction between the normally closed terminal rod NC and the normally open terminal rod NO, to be then press-fitted for installation.

Figure 6:
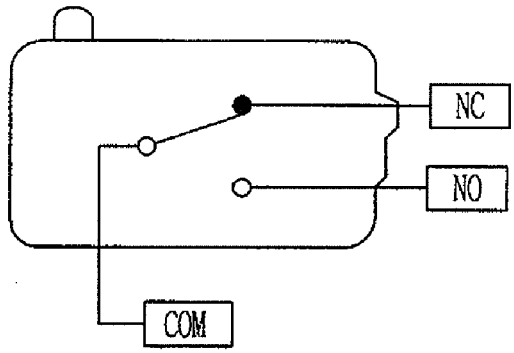
FIG. 6 is a circuit view showing a circuit wire of a double terminal type micro switch in accordance with the present invention.
Figure 7:
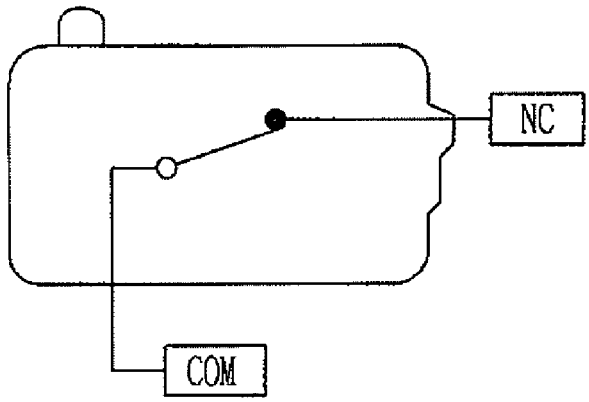
FIG. 7 is a circuit view showing s circuit wire of a normally closed type micro switch in accordance with the present invention.
Figure 8:
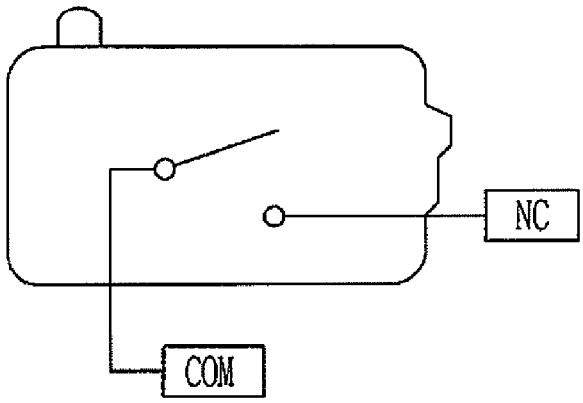
FIG. 8 is a circuit view showing a circuit wire of a normally open type micro switch in accordance with the present invention.

Operations and operation effects of the micro switches 20, 30 and 40 having such configurations according to the present invention will be described with reference to the configuration views of FIGS. 1 to 5 and circuit views of FIGS. 6 to 8.

First, operation and operation effects of the double terminal type micro switch 20 according to the present invention will be described with reference to FIGS. 1 to 3 and FIG. 6.

Normally, i.e., in a state where the plunger 5 is not pressed by the actuator 6, the movable contact 4*a* of the movable contact rod 4 is located at a position where it contacts the normally closed terminal contact NCa of the normally closed terminal rod NC. Accordingly, a current introduced from the power source side via the common terminal COM flows to the movable contact 4*a* via the movable contact rod 4 connected to the common terminal COM, and then heads to the normally closed terminal contact NCa and the normally closed terminal rod NC. Such current then flows to a load device or driving source, e.g., a lamp or motor, connected to the normally closed terminal rod NC via a signal line (not shown). Such current flow is available because the common terminal COM has electrically been connected to the normally closed terminal rod NC as shown in the circuit view of FIG. 6.

Meanwhile, if the plunger 5 is physically pressed by the actuator 6, the movable contact rod 4 is pressed together with the anchor 8 to be all moved down. In more detail, the anchor 8 rotates in a counterclockwise direction centering around the fixed end portion when the plunger 5 is pressed down in FIG. 1, for example. Upon the plunger 5 being pressed, the left end portion of the movable contact 4, for example, shown in FIG. 1, is moved down together with the anchor 8 so as to press the left end portion of the leaf spring 7. In cooperation with the transformation of the left end portion of the leaf spring 7, a right end portion of the leaf spring 7, namely, an end portion having the movable contact 4*a* being attached is also instantaneously moved down by a restoring force of the leaf spring 7 for maintaining its original state. Accordingly, the movable contact 4*a* of the movable contact rod 4 comes in contact with the normally open terminal contact NOa of the normally open terminal rod NO. Each of the micro switches 20, 30 and 40 according to the present invention includes the common terminal COM. Also, since no signal line and load device or driving source are connected to the normally open terminal rod NO, the current flow is cut off at the normally open terminal rod NO, whereby a circuit is open. Here, an electric connection between a power source side (not shown) via the common terminal COM and a load side via a signal line is blocked. Here, when the movable contact 4*a* is separated from the stationary contact (i.e., the normally closed terminal contact NCa), the permanent magnet 10 acts such that an arc generated between the movable contact 4*a* and the normally closed terminal contact NCa is dispersed broadly, thereby rapidly extinguishing the arc. In more detail, assuming that a left side of the permanent magnet 10 is N-pole and a right side thereof is S-pole, a plurality of magnetic fluxes coming out from the N-pole towards the S-pole are generated around the permanent magnet 10. Such magnetic fluxes act such that the arc generated between the movable contact 4*a* and the normally closed terminal contact NCa is dispersed broadly and an arc resistance is increased, and accordingly the arc can rapidly be extinguished.

Operation and operation effects of the normally closed type micro switch 30 according to the present invention will be described with reference to FIGS. 4 and 7.

Normally, i.e., in a state where the plunger 5 is not pressed by the actuator 6, the movable contact 4*a* of the movable contact rod 4 is located at a position where it is in contact with the normally closed terminal contact NCa of the normally closed terminal rod NC. Accordingly, a current introduced from the power source side via the common terminal COM flows to the movable contact 4*a* via the to movable contact rod 4 connected to the common terminal COM, and then heads to the normally closed terminal contact NCa and the normally closed terminal rod NC. Such current then flows to a load device or driving source, e.g., a lamp or motor, connected to the normally closed terminal rod NC via a signal line (not shown). Such current flow is available because of the electric connection between the common terminal COM and the normally closed terminal rod NC as shown in the circuit view of FIG. 7.

Meanwhile, if the plunger 5 is physically pressed by the actuator 6, the movable contact rod 4 is pressed and moved down together with the anchor 8. In more detail, the anchor 8 rotates in a counterclockwise direction centering around the fixed end portion when the plunger 5 is pressed down in FIG. 4, for example. Upon the plunger 5 being pressed, the left end portion of the movable contact 4, for example, shown in FIG. 1, is moved down together with the anchor 8 so as to press the left end portion of the leaf spring 7. In cooperation with the transformation of the left end portion of the leaf spring 7, a right end portion of the leaf spring 7, namely, an end portion having the movable contact 4*a* being attached is also instantaneously moved down by a restoring force of the leaf spring 7 for maintaining its original state. The movable contactor 4*a* of the downwardly moved movable contactor rod 4 comes in contact with the normally open terminal rod NO so as to be stopped accordingly.

Also, since no signal line and load device or driving source are connected to the normally open terminal rod NO, the current flow is cut off at the normally open terminal rod NO, whereby a circuit is open. Here, an electric connection between a power source side (not shown) via the common terminal COM and a load side via a signal wire is blocked. Here, when the movable contact 4*a* is to separated from the stationary contact (i.e., the normally closed terminal contact NCa), the permanent magnet 10 acts such that an arc generated between the movable contact 4*a* and the normally closed terminal contact NCa is dispersed broadly, thereby rapidly extinguishing the arc. Further, in the normally closed type micro switch 30 according to the present invention, since the normally open terminal rod NO has no contact, when the movable contact 4*a* is separated from the stationary contact (i.e., the normally closed terminal contact NCa), the separated distance between the two contacts is increased as far as a height of the non-provided contact. So, the separated distance between the two contacts according to the present invention can be increased 1.5 times more than that in the related art having the normally open terminal rod NO with a contact. Hence, a direct current cut-off capability can effectively be enhanced as well as an effect obtained by employing the permanent magnet 10.

Operation and operation effect of the normally open type micro switch 40 according to the present invention will be described with FIGS. 5 and 8.

Normally, i.e., in a state where the plunger 5 is not pressed by the actuator 6, the movable contact 4*a* of the movable contact rod 4 is located at a position where it contacts the normally open terminal contact NOa of the normally open terminal rod NO. Accordingly, a current introduced from the power source side via the common terminal COM does not flow at the normally open terminal rod NO because a signal line and a load device or driving source, e.g., a lamp or motor, are not connected to the normally open terminal rod NO. Hence, as shown in the circuit view of FIG. 8, the current flowing from the common terminal COM is cut off due to a conductive path not being provided.

Meanwhile, if the plunger 5 is physically pressed by the actuator 6, the movable contact rod 4 is pressed together with the anchor 8 to be all moved down. In more detail, the anchor 8 rotates in a counterclockwise direction centering around the fixed end portion when the plunger 5 is pressed down in FIG. 5, for example. Upon the plunger 5 being pressed, the left end portion of the movable contact 4, for example, shown in FIG. 5, is moved down together with the anchor 8 so as to press the left end portion of the leaf spring 7. At this time, a right end portion of the leaf spring 7, namely, an end portion having the movable contact 4*a* being attached is also instantaneously moved down by a restoring force of the leaf spring 7 for maintaining its original state. Accordingly, the movable contact 4*a* of the downwardly-moved movable contact rod 4 comes in contact with the normally closed terminal contact NCa of the normally closed terminal rod NC so as to configure a closed circuit together with a load side or driving source side (e.g., a lamp, a motor and the like) connected via a signal line (not shown). Accordingly, a current introduced from the power source side via the common terminal COM flows to the movable contact 4*a* via the movable contact rod 4 connected to the common terminal COM. Such current then passes through the normally closed terminal contact NCa and the normally closed terminal rod NC to head towards the lamp or motor connected to the normally closed terminal rod NC via a signal line (not shown).

In the meantime, when the plunger 5 is no more physically pressed by the actuator 6, the anchor 8 rotates in a clockwise direction centering around the fixed end portion by an elastic restoring force. Accordingly, the left end portion of the movable contact 4 is moved up in FIG. 5 together with the anchor 8 so as to press the left end portion of the leaf spring 7. Then, the right end portion of the leaf spring 7, namely, an end portion having the movable contact 4*a* attached, is also instantaneously moved up by the restoring force of the leaf spring 7 for maintaining its original state. Thus, the movable contact 4*a* of the upwardly-moved movable contact rod 4 comes in contact with the normally open terminal rod NO. Hence, since no signal line and load or driving source are connected to the normally open terminal rod NO, a current flow is cut off at the normally open terminal rod NO, whereby a circuit is open. Here, an electric connection between a power source side (not shown) via the common terminal COM and a load side via a signal wire is blocked. Here, when the movable contact 4*a* is separated from the stationary contact (i.e., the normally closed terminal contact NCa), the permanent magnet 10 acts such that an arc generated between the movable contact 4*a* and the normally closed terminal contact NCa is dispersed broadly, thereby rapidly extinguishing the arc. In the normally open type micro switch 40 according to the present invention, since the normally open terminal rod NO has no contact, when the movable contact 4*a* is separated from the stationary contact (i.e., the normally closed terminal contact NCa), the separated distance between the two contacts is increased as far as a height of the non-provided contact. So, the separated distance between the two contacts can be increased 1.5 times more than that in the related art having the normally open terminal rod NO with a contact. Hence, a direct current cut-off capability can effectively be enhanced as well as an effect obtained by employing the permanent magnet 10.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the is above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A micro switch, comprising:

a first stationary contact and a second stationary contact, the first stationary contact and the second stationary contact being spaced apart from each other with respect to a vertical direction, the vertical direction being defined in a direction in which a movable contact is movable, the movable contact having a position where it contacts the first stationary contact and a position where it is separated from the first stationary contact so as to move towards the second stationary contact, a movable contact rod that supports the movable contact, a plunger that pressurizes the movable contact rod upon being pressed, and a leaf spring that supplies a driving force to the movable contact rod to change a position of the movable contact, a permanent magnet installed at a position adjacent to the movable contact, the first stationary contact, and the second stationary contact, and the permanent magnet being positioned between the first stationary contact and the second stationary contact with respect to the vertical direction.

2. A micro switch, comprising:

a normally closed terminal rod having a stationary contact, a movable contact configured to contact the stationary contact of the normally closed terminal rod when the movable contact is in a closed position and an open position where it is the movable contact is configured to be separated from the stationary contact of the normally closed terminal rod, a movable contact rod that supports the movable contact, a plunger that pressurizes the movable contact rod upon being pressed, and a leaf spring that supplies a driving force to the movable contact rod to change a position of the movable contact, a permanent magnet installed at a position adjacent to the movable contact and the stationary contact of the normally closed terminal rod, and a stopper configured to restrict the movement of the movable contact when the movable contact is separated from the stationary contact of the normally closed terminal rod, the stationary contact and the stopper being spaced apart from each other with respect to a vertical direction, the vertical direction being defined in a direction in which the movable contact is movable, and the permanent magnet being positioned between the stationary contact and the stopper with respect to the vertical direction.

3. The micro switch of claim 2, wherein the stopper is configured as a terminal rod having a length different from that of the normally closed terminal rod.

4. The micro switch of claim 2, wherein the stopper is configured as a normally open terminal rod.

5. The micro switch of claim 2, wherein the stopper is configured as a flat plate member without a protruded contact.

6. The micro switch of claim 2, wherein the stopper comes in contact with the movable contact in a state where the plunger is not pressed, and is configured as a terminal rod having a length different from that of the normally closed terminal rod.

7. A micro switch, comprising:

a normally closed terminal rod with a first stationary contact, a normally open terminal rod with a second stationary contact, the first stationary contact and the second stationary contact being spaced apart from each other with respect to a vertical direction, the vertical direction being defined in a direction in which a movable contact is movable, the movable contact having a closed position where it contacts the first stationary contact of the normally closed terminal rod and an open position where it contacts the second stationary contact of the normally open terminal rod, a movable contact rod that supports the movable contact, a plunger that pressurizes the movable contact rod upon being pressed, and a leaf spring that supplies a driving force to the movable contact rod to change a position of the movable contact, a permanent magnet installed at a position adjacent to the movable contact, the first stationary contact, and the second stationary contact, and the permanent magnet being positioned between the first stationary contact and the second stationary contact with respect to the vertical direction.

* * * * *